US012546559B2

(12) United States Patent
Trpkovski

(10) Patent No.: US 12,546,559 B2
(45) Date of Patent: Feb. 10, 2026

(54) CRANK-OPERATED AIRGUN WITH CABLE AND CAM SYSTEM

(71) Applicant: Crosman Corporation, Bloomfield, NY (US)

(72) Inventor: Paul Trpkovski, Kailua Kona, HI (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 18/971,743

(22) Filed: Dec. 6, 2024

(65) Prior Publication Data

US 2025/0189265 A1 Jun. 12, 2025

Related U.S. Application Data

(60) Provisional application No. 63/607,417, filed on Dec. 7, 2023.

(51) Int. Cl.
*F41B 11/681* (2013.01)

(52) U.S. Cl.
CPC ..... *F41B 11/681* (2013.01)

(58) Field of Classification Search
CPC ..... F41B 11/681
USPC ..... 124/69
See application file for complete search history.

(56) References Cited

U.S. PATENT DOCUMENTS

| | | | | |
|---|---|---|---|---|
| 1,183,644 | A * | 5/1916 | Hill | F41B 11/72 124/75 |
| 6,170,477 | B1 * | 1/2001 | Horlock | F41B 11/83 124/80 |
| 6,220,237 | B1 * | 4/2001 | Johnson | F41B 11/89 124/75 |
| 6,276,353 | B1 * | 8/2001 | Briggs | F41B 11/57 124/71 |
| 2009/0145412 | A1 * | 6/2009 | Barish | F41B 11/89 124/1 |
| 2010/0212481 | A1 * | 8/2010 | Koth | F41A 1/00 124/75 |

* cited by examiner

*Primary Examiner* — Bret Hayes
(74) *Attorney, Agent, or Firm* — Lee & Hayes, P.C.

(57) ABSTRACT

An airgun pressure system as described herein includes a pressure chamber comprising a cylinder extending along a length of an axis of the airgun parallel with an axis of a barrel of the airgun. The airgun also includes a piston disposed within the pressure chamber and translatable along a length of the cylinder to pressurize gas in the pressure chamber in response to an increase in force applied to the piston. The airgun also includes a rotating drum connected to a frame of the airgun, a cable operably connected to the piston and the rotating drum, and a crank handle operably connected to the rotating drum and configured to cause rotation of the rotating drum to increase tension on the cable and force on the piston to compress the gas in the pressure chamber.

20 Claims, 15 Drawing Sheets

CRANK-OPERATED AIRGUN WITH CABLE AND CAM SYSTEM

RELATED APPLICATION

This application claims priority to U.S. Provisional Application No. 63/607,417, filed Dec. 7, 2023, the entire contents of which is incorporated herein by reference in its entirety and for all purposes.

BACKGROUND

Airguns and other air powered projectile launchers have been known for many years and are differentiated from firearms in that airguns use compressed air as a primary propellant. This air may be pre-compressed by a pump or other system such as is known in pre-charged pneumatic (PCP) airguns, such as the Crosman Challenger® sold by Crosman Corporation, Bloomfield, NY, USA. Such guns include a reservoir that stores air that has been compressed to pressures that are typically well above 100 bar. When such PCP airguns are fired an amount of air is released from reservoir and used to propel the pellet.

PCP airguns exhibit limited recoil and can be capable of semi-automatic fire. However, high pressure pumping equipment is required adding cost and expense to the use of such products. Some airguns have mountings allowing a compressed gas storage vessel to be removably mounted to the airgun to allow for rapid recharging of the airguns. Some examples of this type of use compressed air tanks which offer many of the advantages of PCP airguns however such removably mountable gas storage vessels can be expensive and require additional hardware that can make such airguns costly and complex.

In some airguns, the airgun is provided with an onboard pumping solution. In this design multiple pump actions are used to build up a volume of compressed air in an onboard storage chamber. In some cases, the storage chamber is sized to receive and store a single shot volume of compressed gas. To make pumping easier, such airguns typically require multiple pumps to store the single shot volume. This limits the ability of the shooter to make a rapid follow up shot and can be fatiguing over time when sighting in the airgun or engaging in target practice.

Another approach is to use a spring to store energy. The most popular spring type airgun is known as a break barrel airgun. In this common airgun in which a barrel is pivotably mounted to the receiver and stock of the airgun. In such airguns, pivoting the barrel relative to the stock simultaneously opens the barrel to permit loading a pellet into the barrel. This opening action is also used to store energy in a mechanical spring or gas spring. The barrel is then rotated to close the barrel against the receiver. When the airgun is fired, energy from the spring drives a piston that is located in a compression tube. This drives any air in the compression tube into a much smaller transfer tube and barrel where the now compressed air thrusts the projectile from the barrel. The break barrel design has long been popular with consumers. However, all of the firing energy must be stored in the spring in a single pivot of the barrel relative to the stock. This can require that a user exert a significant amount of force in pivoting the barrel to prime the piston. This can make break barrel airgun difficult to use by some people.

Other approaches have been tried. For example, crank systems for cocking a spring have been proposed. In some of these, manual cranks have been provided. Alternatively, a motorized crank system has been described in commonly assigned U.S. patent application Ser. No. 17/696,632, entitled "Air Gun with Automatic Cocking." Such systems have often required complex and unusual gearing arrangements that must be robust enough to reliably operate against the high forces imposed by the spring and to survive the shock and vibration caused when the piston is fired. Such arrangements therefore make the airgun heavier and more complex. Further, in some airguns having a cranking system, the piston itself carries structures to enable the crank to drive movement of the piston against the spring. These structures add mass to the piston that, in turn, creates inertial resistance to the acceleration of the projectile. that the spring must overcome when thrusting the piston during firing.

Finally, what is needed is an airgun that provides novel methods of energy storage for subsequently imparting energy to a projectile.

BRIEF DESCRIPTION OF THE DRAWINGS

The detailed description is set forth below with reference to the accompanying figures. The systems depicted in the accompanying figures are not to scale and components within the figures may be depicted not to scale with each other.

DETAILED DESCRIPTION

A crank-based system for storing energy (e.g., pressurizing a gas) that may be released to launch a projectile from an airgun is disclosed. The crank-based system uses one or more powered or hand-driven cranks to rotate a series of gears to provide a mechanical advantage that enables compression of gas within a cylinder. The series of gears couple to a cam or capstan that has a cord, string, cable, or other tension-bearing device coupled thereto. The cable couples to a piston within a cylinder. Rotation of the gears causes rotation of the cam or capstan and winds the cable about the capstan to shorten the length of cable extending from the system. As the cable is wound about the capstan, the piston is drawn along the length of the cylinder, compressing the volume of gas. The series of gears also includes a sear or other such device to releasably latch to the series of gears and/or piston when the gas is compressed, to maintain the piston in position such that the pressurized gas may be used to launch a projectile from the airgun.

The present description provides an overall understanding of the principles of the structure, function, manufacture, and use of the systems and methods disclosed herein. One or more examples are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

Additional details are described below with reference to several example embodiments.

Figure 1:
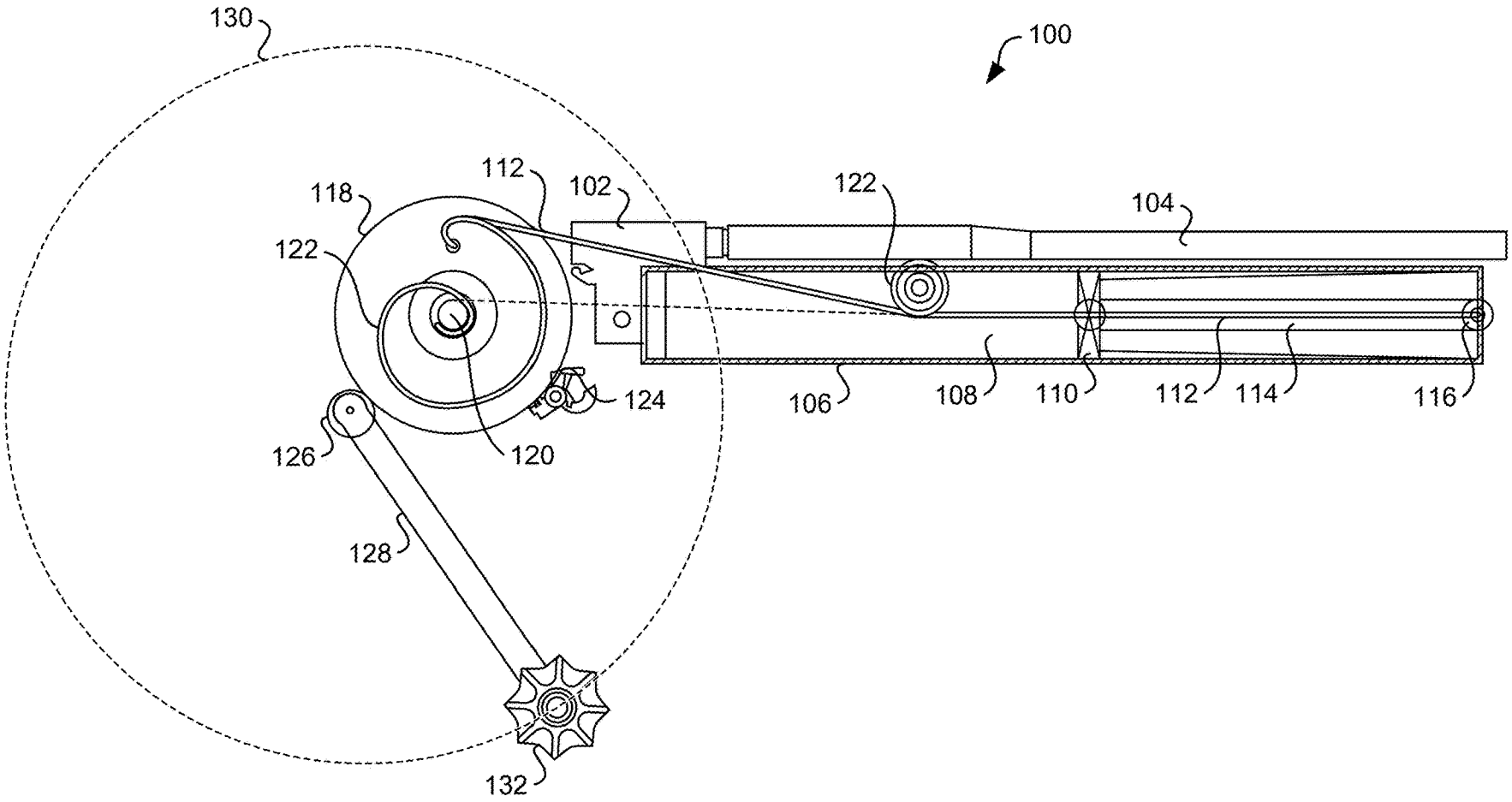
FIG. 1 is an illustration of a crank system for an airgun, according to an example.

FIG. 1 is an illustration of a crank system 100 for an airgun, according to an example. The crank system 100 is fitted to a receiver 102 and barrel 104 of airgun and used to pressurize a pressure chamber 106 for launching projectiles along the barrel 104. The crank system 100 pressurizes a gas 108 within the pressure chamber 106 by causing a piston 110 to move along the length of the pressure chamber 106 to reduce the volume of the pressure chamber 106 containing the gas 108. The piston 110 is connected to a rod 114 with an end 116 at an end of the rod positioned adjacent the distal end of the pressure chamber 106 from the receiver 102. A cable 112 extends along the length of the pressure chamber 106 from a drum 118 and loops around the end 116 of the rod 114 to compress the gas 108 as the cable 112 is retracted.

As the piston 110 is drawn backwards (e.g., to the left in FIG. 1), through rotation of a crank 128, the volume of the gas 108 is reduced and the pressure increases. The crank 128 may be rotated until a desired pressure level is reached, until the piston 110 reaches a desired location, the crank 128 reaches a desired rotation angle, or any other suitable location. After the gas 108 is pressurized, the gas may be released into the receiver 102 and barrel 104 through a valve system in response to a trigger mechanism of the airgun, and the pressurized gas that is released may drive the projectile along the barrel 104 to launch the projectile.

The crank system 100 includes a drum 118 that receives the cable 112 to wind around the perimeter of the drum 118 as the drum 118 is rotated. The drum 118 rotates around a pivot 120 to wind the cable 112 and move the piston 110 to cause the pressure in the pressure chamber 106 to increase. The drum 118 includes a spiral surface 122 that begins at or near the perimeter of the drum 118 and spirals towards the pivot 120. The spiral surface 122 causes the rate at which the cable 112 is retracted onto the drum to change over the travel of the drum 118. The spiral surface 122 results in the distance the cable 112 is retracted as the drum 118 is rotates counter-clockwise in FIG. 1 to decrease per degree of rotation of the drum as the cable 112 is wound around the spiral surface 122 of the drum 118.

The cable 112 wraps around the drum 118, and may wrap at a single fixed diameter or may wrap at a varying diameter (e.g., on an eccentric cam shape of the spiral surface 122) such that the rate at which the cable 112 is drawn back may be constant or variable. The cable 112 couples, at a distal end, in some examples, to the end 116 of the rod 114 and piston 110. The cable 112 may, in some examples, wrap around the end 116 of the rod 114 and be connected at a fixed location on the airgun, which may provide for increased force to be applied against the piston 110 as compared with connecting the cable 112 directly to the rod 114 and/or piston 110.

As illustrated in the figures, the spiral surface 122 enables the cable 112 to wrap around a first initial diameter, and around a decreasing diameter as the drum 118 is continually rotated. For instance, the cable 112 may initially wrap around a drum 118 with a diameter of around four inches to draw the piston 110 towards the rear of the airgun and compress the gas 108 within the pressure chamber 106. The diameter of the spiral surface 122 may reduce, towards the end of the compression cycle (e.g., as the piston 110 reaches a final position within the pressure chamber 106), to a diameter of around one-half inch. In some examples, the cable 112 may wrap around a drum 118 of a diameter around 4 inches, and then reduce to a spiral helical pitch of the spiral surface 122 for three turns reducing in diameter from 3.75 inches or 4 inches down to 0.5 inches.

At or near the end of the compression of the piston 110 (e.g., as the piston 110 approaches the bottom of the pressure chamber 106 towards a rear of the airgun), the diameter of the drum 118 may reduce, for example by having the cable 112 wrap around the drum 118 in a track such that at the end of the compression of the piston 110 within the pressure chamber 106, when the pressure is the highest, the cable 112 may wrap around a decreasing diameter, enabling the user to apply force through the crank 128 that is at or near an approximately equal force throughout the compression of the gas 108, even as the pressure level within the pressure chamber 106 grows and the force required to continue to compress increases.

The crank system 100 further includes a ratchet system 124 that engages with a diameter of the drum 118 and/or with teeth or features at the perimeter of the drum 118 to prevent rotation of the drum 118 in a clockwise direction until the ratchet system 124 is released.

A crank gear 126 also engages with a diameter of the drum 118 to cause rotation of the drum 118 as the crank gear 126 is rotated due to force applied to the crank 128 through a crank handle 132 when the crank handle 132 is rotated about rotation 130. The crank handle 132 causes rotation of the crank gear 126 that in turn causes rotation of the drum 118 and wraps up the cable 112 attached to the piston 110 so that the piston 110 slides in the pressure chamber 106. The crank handle 132 and crank 128 are coupled to a first gear (e.g., crank gear 126) that is coupled to a second gear attached to or integral with the drum 118. The drum 118 includes a post or securement where the cable 112 attaches. Rotation of the crank 128 on the crank gear 126 drives rotation of the drum 118, and the mechanical advantage of the gearing is used to provide for storing of energy and cranking the crank system 100 without requiring undue force or effort from the user.

Figure 2:
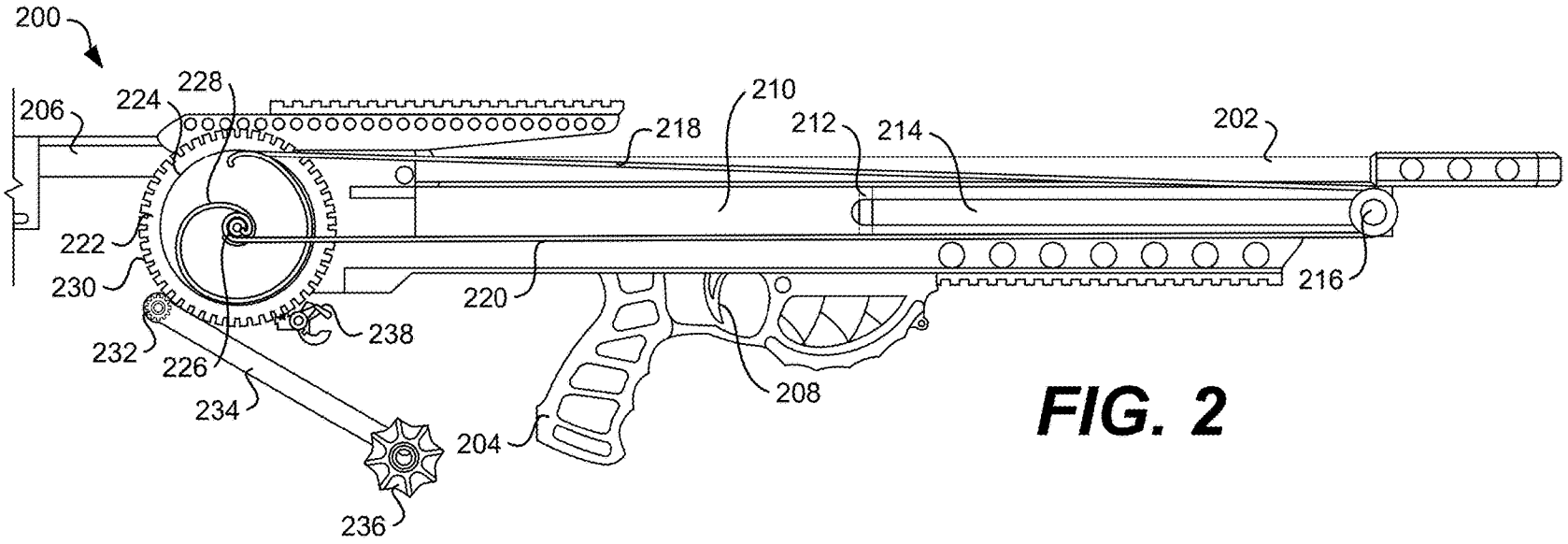
FIG. 2 illustrates an airgun with a crank system in a first state of charge, according to an example.
Figure 3:
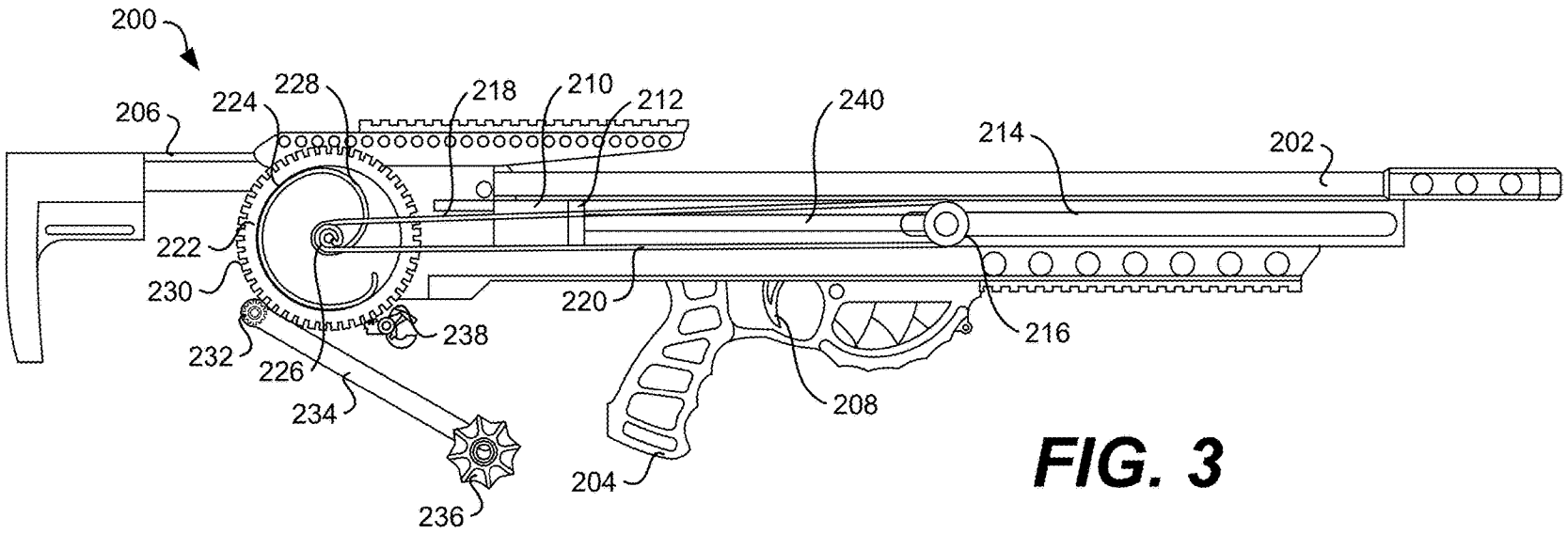
FIG. 3 illustrates the airgun of FIG. 2 in a second state of charge, according to an example.

FIGS. 2-3 include illustrations of an airgun that implements the crank system 100 of FIG. 1. FIG. 2 illustrates an airgun 200 with a crank system in a first state of charge, according to an example. The airgun 200 is depicted with a barrel 202, grip 204, stock 206, and trigger 208 used to interact with the airgun 200 and fire projectiles down the barrel 202 using pressurized gas.

The airgun 200 includes a pressure chamber 210 where gas is compressed by a piston 212 as the piston 212 is drawn towards the rear of the airgun 200. The piston 212 is connected to a bearing 216 through a linkage such that the bearing 216 rides along a slot 214 in the wall of the pressure chamber at a portion of the pressure chamber forward of the piston 212. A cable 218 is used to draw the bearing 216 and piston 212 towards the rear of the airgun 200 and compress gas within the pressure chamber 210.

The cable 218 wraps around the bearing 216 and cable 220 extends from the bearing 216 towards the rear of the airgun in parallel with the cable 218. In examples, the cable 218 and the cable 220 may be a single cable that passes around the bearing 216. The cable 218 extends to a drum 222 and the cable 220 extends to the drum 222 as well. As the drum 222 is rotated in a counter-clockwise direction, the cable 218 and the cable 220 are wound around the drum 222 to draw the piston 212 towards the rear and pressurize the gas within the pressure chamber 210.

The drum 222 rotates around a pivot to wind the cable 218 about a first diameter 224 and wind the cable 220 around a second diameter 226. The drum 222 also includes a spiral surface 228 that begins at or near the first diameter 224 and spirals towards the second diameter 226. The spiral surface 228 causes the rate at which the cable 218 is retracted onto the drum 222 to change over the travel of the drum 222. The spiral surface 228 results in the distance the cable 218 is retracted as the drum 222 is rotates counter-clockwise in FIG. 2 to decrease per degree of rotation of the drum 222 as the cable 218 is wound around the spiral surface 228 of the drum 222.

The cable 218 extends from the drum 222 to the bearing 216 that is coupled to the piston 212, and couples to a second location on the drum 222 with cable 220. In some examples the cable 218 may pass over the bearing 216 and connect to a fixed location on the airgun 200. The doubling over of the cable 218 and cable 220 may enable additional force to be applied to the piston through the cable 218.

The cable 218 wraps around the drum 222 at the first diameter 224 before wrapping along the spiral surface 228 (e.g., on an eccentric cam shape of the spiral surface 122) such that the rate at which the cable 218 is drawn back may be constant or variable. The cable 220 wraps around the drum 222 at the second diameter 226 and may continue to wrap at the constant second diameter.

As illustrated in the figures, the spiral surface 228 enables the cable 218 to wrap around a first initial diameter (e.g., first diameter 224), and around a decreasing diameter as the drum 222 is continually rotated. For instance, the cable 218 may initially wrap around a drum 222 to draw the piston 212 towards the rear of the airgun 200 and compress the gas within the pressure chamber 210. The diameter of the spiral surface 228 may reduce, towards the end of the compression cycle (e.g., as the piston 212 reaches a final position within the pressure chamber 210), to a diameter of around one-half inch. In some examples, the cable 218 may wrap around an initial drum diameter, such as the first diameter 224, e.g., a diameter around 4 inches, and then reduce to a spiral helical pitch of the spiral surface 228 for three turns reducing in diameter from 3.75 inches or 4 inches down to 0.5 inches.

At or near the end of the compression of the piston 212 (e.g., as the piston 212 approaches the bottom of the pressure chamber 210 towards a rear of the airgun 200), the diameter of the drum 222 may reduce, for example by having the cable 218 wrap around the drum 222 in a track such that at the end of the compression of the piston 212 within the pressure chamber 210, when the pressure is the highest, the cable 218 may wrap around a decreasing diameter, enabling the user to apply force through the crank 234 that is at or near an approximately equal force throughout the compression of the gas, even as the pressure level within the pressure chamber 210 grows and the force required to continue to compress increases.

The airgun 200 is depicted with a crank 234 that couples to a crank gear 232 driving the drum 222 to draw the cable 218 to drive the piston 212 and pressurize gas within the pressure chamber 210 of the airgun 200. The crank 234 has a crank handle 236 that a user may grasp to rotate the crank 234. A ratchet system 238 engages with teeth 230 disposed about the perimeter of the drum 222 to prevent rotation of the drum 222 in a clockwise direction unless the ratchet system 238 is released.

In FIG. 2, the airgun 200 is shown with the pressure chamber 210 in a first state such as an uncompressed state. In FIG. 3, the airgun 200 is shown with the piston 212 compressed within the pressure chamber 210 to pressurize the gas in the pressure chamber 210. The piston 212 is depicted moved towards the rear of the airgun 200 in FIG. 3 with the bearing 216 connected to the piston 212 through linkage 240 moved towards a rear of the slot 214. This bearing 216 provides a visual representation of the amount of compression of the gas in the pressure chamber 210 and provides stability to the piston 212 during compression.

Figure 4:
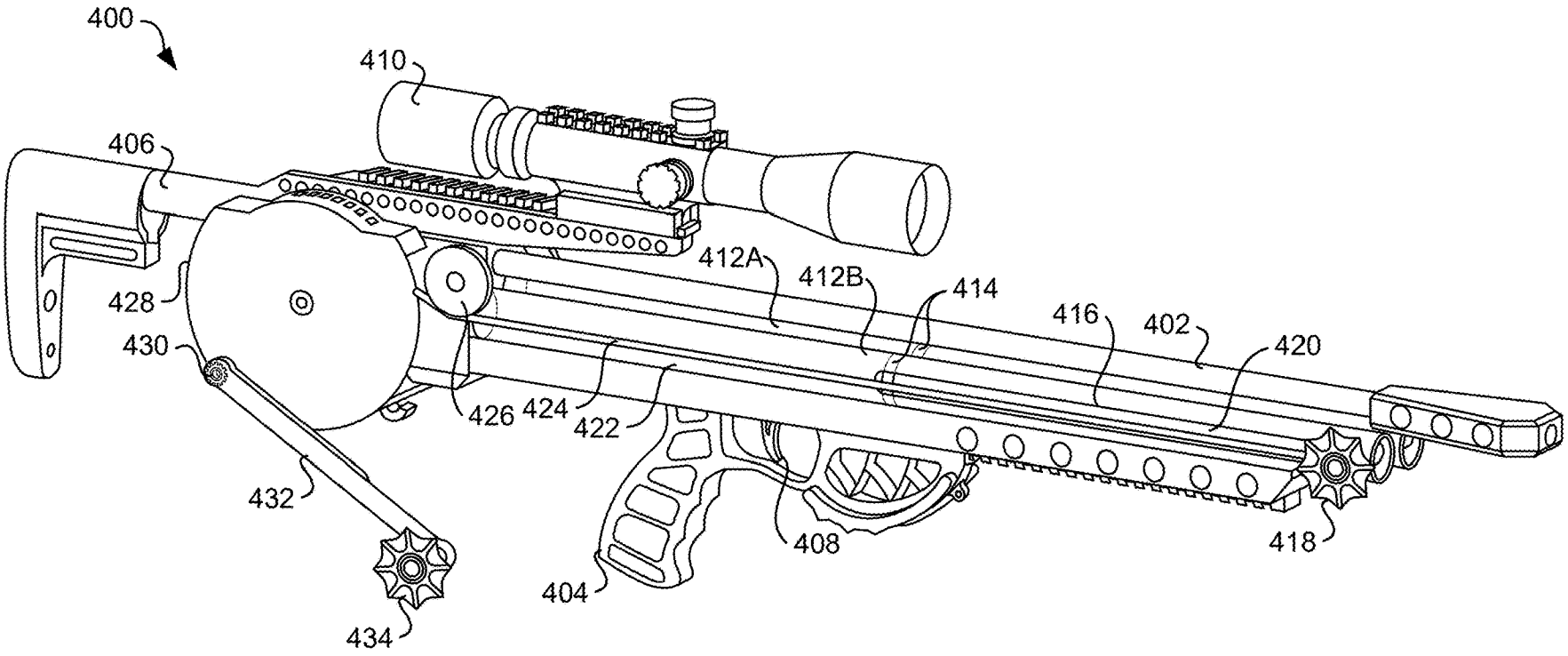
FIG. 4 illustrates an airgun with a crank system for charging two air cylinders, according to an example.
Figure 5:
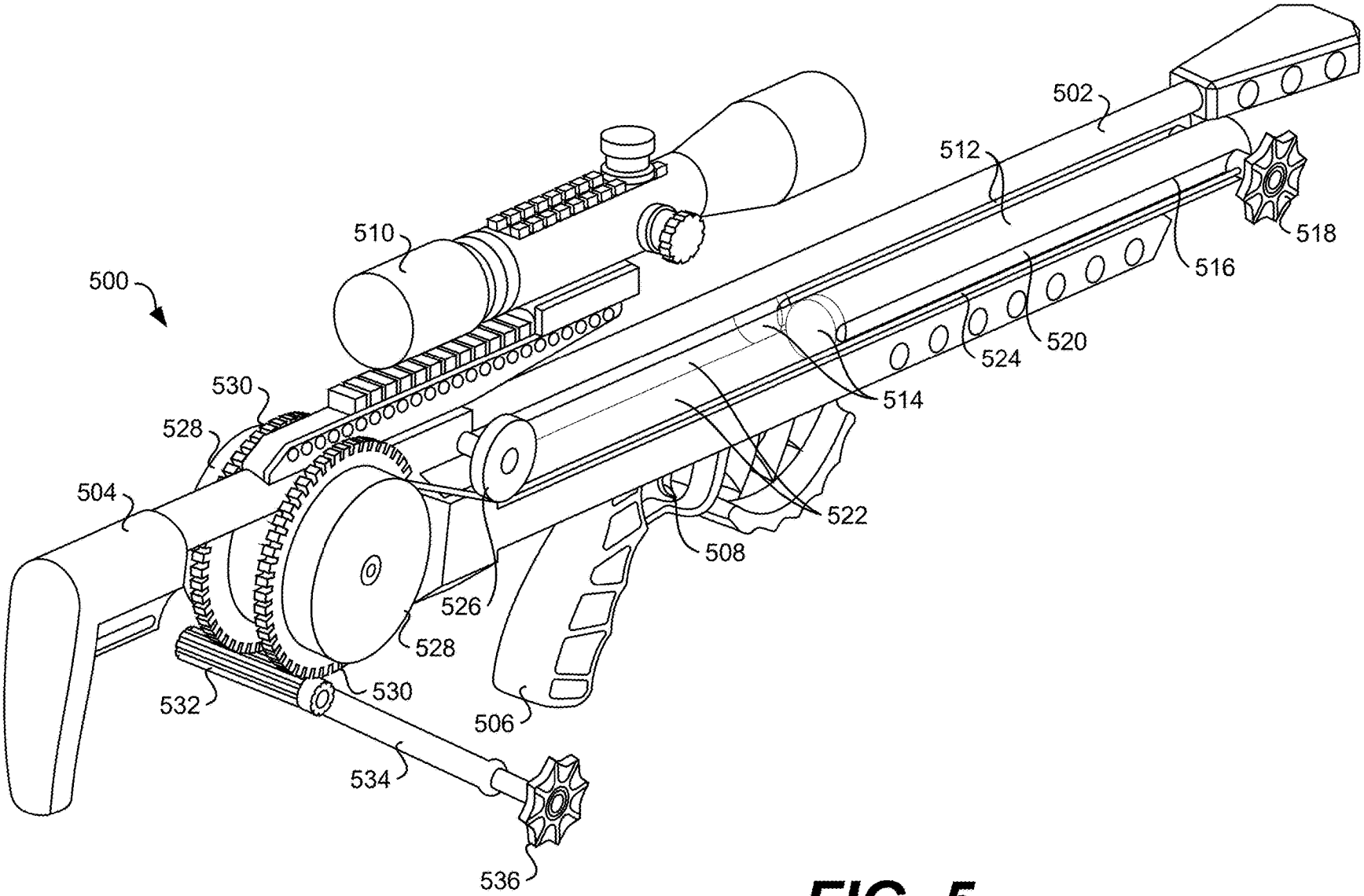
FIG. 5 illustrates the airgun of FIG. 4 with a cover of the crank system removed, according to an example.

In some examples, such as depicted in FIGS. 4 and 5, the airgun may have two or more chambers containing gas that may be pressurized through the use of a single (or multiple) crank systems. In some examples the chamber may be pressurized separately. In some examples, one or more of the chambers may be pre-charged or pressurized through a separate means (e.g., a hand pump) and the cam system may be used to further increase the pressure of the gas.

FIG. 4 illustrates an airgun 400 having an optic 410 with a crank system for charging two air cylinders, according to an example. The airgun 400 includes components similar or identical to those described above, including at least a barrel 402 similar or identical to the barrel 202, grip 404 similar or identical to grip 204, stock 406 similar or identical to stock 206, trigger 408 similar or identical to trigger 208 in addition to components of the crank system. The crank system of the airgun 400 includes a slot 416, linkage 420, cable 424, crank gear 430, crank 432, and crank handle 434 similar or identical to the slot 214, linkage 240, cable 218, crank gear 232, crank 234, and crank handle 236.

The airgun 400 depicted in FIG. 4 may have two or more pressure chambers 412A and 412B (collectively pressure chambers 412) containing gas 422 that may be pressurized through the use of a single (or multiple) crank systems. In some examples the pressure chambers may be pressurized separately. In some examples, such as shown and described with respect to FIG. 16, one or more of the pressure chambers 412 may be pre-charged or pressurized through a separate means (e.g., a hand pump) and the crank system may be used to further increase the pressure of the gas after the pre-charge pressure is achieved.

The airgun 400 is shown with pressure chambers 412 arranged in parallel with each other and with the barrel 402. Each of the pressure chambers 412 has a piston 414 with an associated linkage 420 and bearing 418. The pressure chamber 412B has a bearing 418 on a first lateral side of the airgun 400 and the pressure chamber 412A has a bearing (not shown) and linkage (not shown) associated with the piston 414 disposed on a second lateral side of the airgun 400. A separate cable (not shown) may wind around the bearing for the piston 414 of the pressure chamber 412A. In some instances, a separate crank 432 may engage a drum for winding the cable associated with the pressure chamber 412A. In the example shown in FIG. 4, the drum 428 may be engaged by a single crank 432 to wind both cables simultaneously.

The cable 424 may pass through a guide 426 on a pivot that guides the cable 424 as it leaves the drum 428 and is guided towards the bearing 418. In this manner, the guide 426 may prevent the angle formed by the cable and the axis of the barrel of the airgun from changing as the drum 428 rotates. The guide 426 may maintain the force on the bearing (and thus on the piston 414) to be in line with the axis of the pressure chamber and prevent loading vertically in a direction perpendicular to the barrel 402 and/or the pressure chambers 412.

FIG. 5 illustrates the airgun 500 with a cover of the crank system removed, according to an example. The airgun 500 may be an example of the airgun 400 of FIG. 4 and includes a barrel 502, stock 504, grip 506, trigger 508, optic 510, pressure chambers 512, pistons 514, slot 516, bearing 518, linkage 520, gas 522, cable 524, and guide 526 as described above with respect to FIG. 4 or other embodiments described herein. The airgun 500 includes drums 528, one on each lateral side of the airgun 500 and associated with distinct cables for compressing the pistons 514. The drums 528 are coupled with a gear component 530 that is driven by the crank gear 532, crank 534, and crank handle 536 to rotate the drums 528 and compress the pistons 514. In examples, the drums 528 may each have distinct or separate cranks or may share a crank gear 532 such as depicted in FIG. 5.

Figure 6:
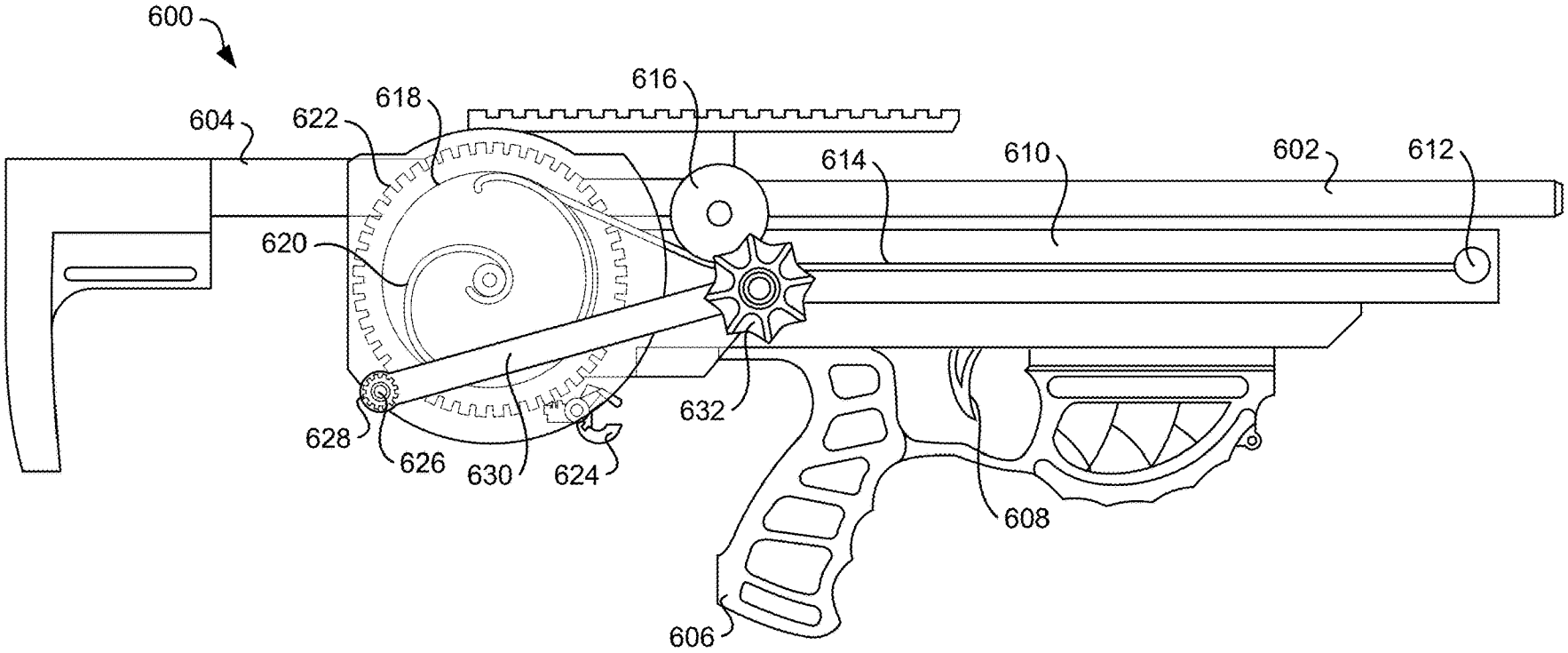
FIG. 6 illustrates a side view of a crank system for an airgun, according to an example.
Figure 7:
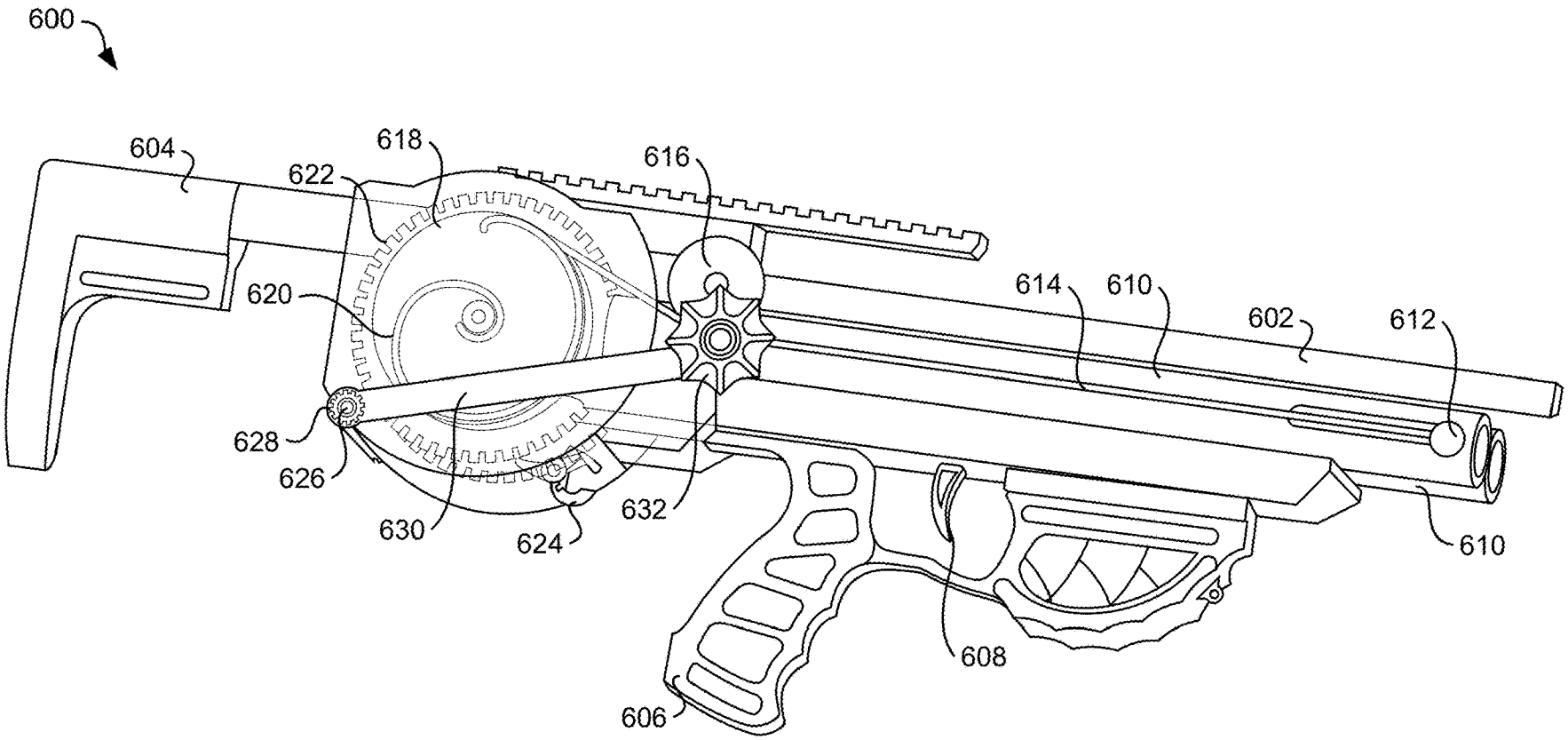
FIG. 7 illustrates a perspective view of the airgun of FIG. 6, according to an example.

FIGS. 6 and 7 illustrates a side view of a crank system for an airgun 600, according to an example. The airgun 600 includes components similar or identical to those described herein including at least a barrel 602, stock 604, grip 606, trigger 608, pressure chamber 610, bearing 612, cable 614, guide 616, drum 618, spiral surface 620, gear 622, ratchet system 624, gear crank 628 that rotates about pivot 626, crank 630, and crank handle 632. The airgun 600 may be an example of a crank system in a multi-shot airgun. The crank 630 may be positioned behind or adjacent a stock of the airgun 600 when stowed and/or adjacent a trigger mechanism or assembly.

Figure 8:
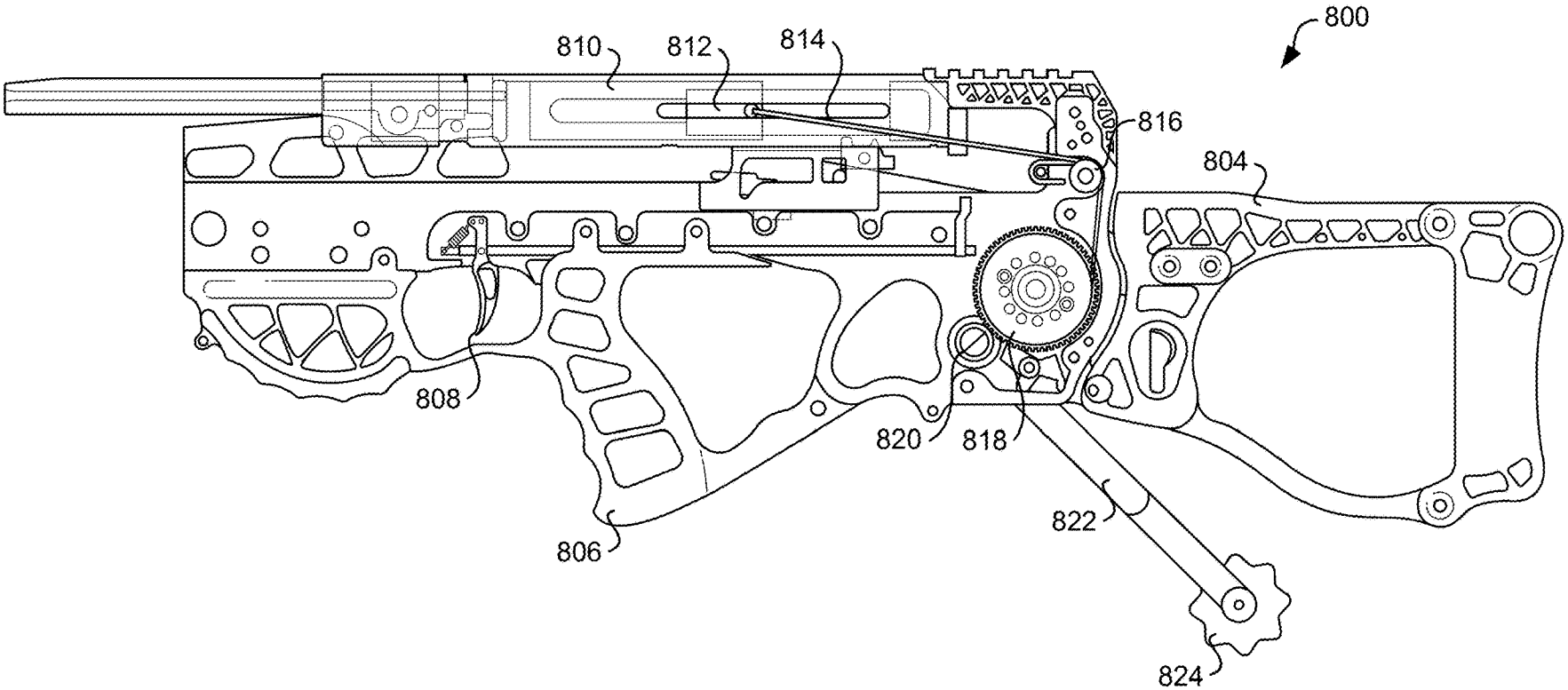
FIG. 8 illustrates a section view of an airgun having a crank and cable system for charging an air cylinder, according to an example.

FIG. 8 illustrates a section view of an airgun 800 having a crank and cable system for compressing a pressure chamber, according to an example. The airgun 800 may be an example of an embodiment that implements a crank system similar to that described above with respect to FIG. 1. In particular, the airgun 800 may be an air rifle, air pistol, or other such airgun. The airgun 800 may use a system to provide the crank capability in a compact frame or system such as that of an air pistol.

The airgun 800 includes a barrel, stock 804, grip 806, and trigger 808 as is conventionally used in airguns. The airgun 800 includes a pressure chamber 810 with a piston 812 that may be drawn towards the rear of the airgun 800 using a cable 814. The piston 812 may be coupled directly to the cable 814 and/or through a rod similar to the crank system 100 of FIG. 1. The cable 814 is routed from the piston 812 around a pulley 816 to a drum 818. The drum 818 is depicted as a drum 818 having a constant diameter for winding the cable 814 but may also include a variable diameter surface such as the spiral surface of FIG. 1. The drum 818 is connected to a series of gear teeth by either including gear teeth at a perimeter of the drum 818 and/or being coupled to a gear having the gear teeth. The drum 818 is driven by a crank gear 820 that is connected to the crank 822 and crank handle 824 to cause rotation of the drum 818 for compressing gas in the pressure chamber 810. The drum 818 may engage with a ratchet system to prevent backwards rotation of the drum 818 until the ratchet system is released. Though depicted as winding the cable 814 in FIG. 8, the drum 818 and the gear teeth may be used to drive one or more gear racks (not shown) that may be used to move the piston 812 in place of the cable 814.

Figure 9:
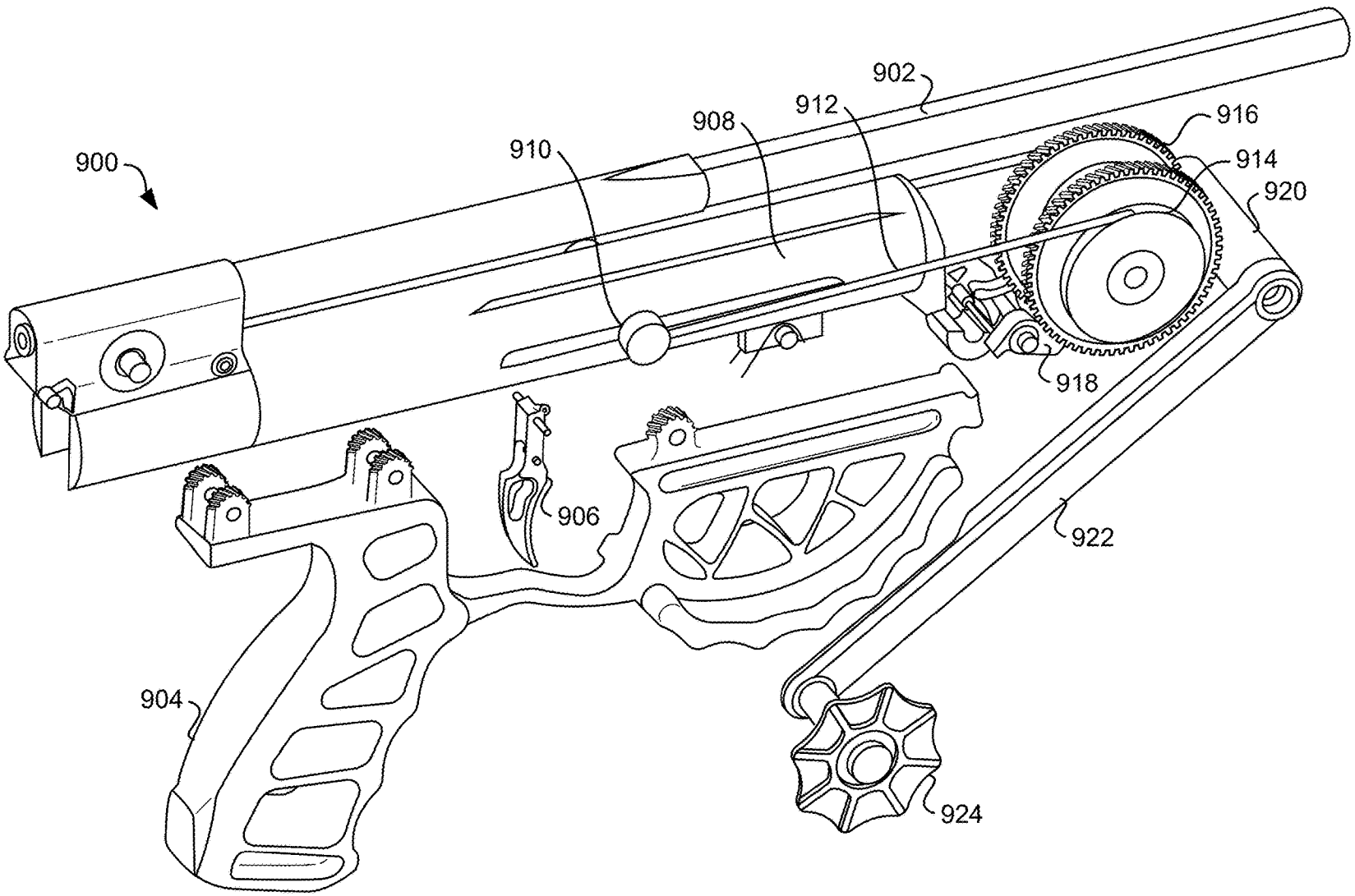
FIG. 9 illustrates a partial exploded view of an airgun having a crank and cable system for charging an air cylinder, according to an example.

FIG. 9 illustrates a partial exploded view of an airgun 900 having a crank and cable system for charging an air cylinder, according to an example. The airgun 900 includes a barrel 902, grip 904, and trigger 906 and is depicted as an air pistol. The airgun 900 includes a drum 914 that is positioned forward of the trigger 906 in contrast to the drums of other examples described herein that may be positioned rearward of the trigger. The drum 914 being positioned forward of the trigger 906 may enable a more compact assembly for the air pistol configuration.

The airgun 900 includes a post 910 for connecting the cable 912 between the drum 914 and the piston (not shown) that rides within the pressure chamber 908. The cable 912 may wrap around the drum in a manner similar or identical to other drum configurations described herein. The drum 914 may include a constant diameter for wrapping the cable 912 as the drum 914 is rotated and/or may also include a spiral surface or other variable diameter surface as described herein. The drum 914 may be driven through gear teeth 916 that interface with a crank gear 920 driven by a crank 922 and crank handle 924 to wind the cable 912 about the drum 914. The gear teeth 916 may also engage with a ratchet system 918 to prevent backwards rotation of the drum 914 while the user cranks the crank 922 or after completing rotation of the drum 914 to wind the cable 912.

Figure 10:
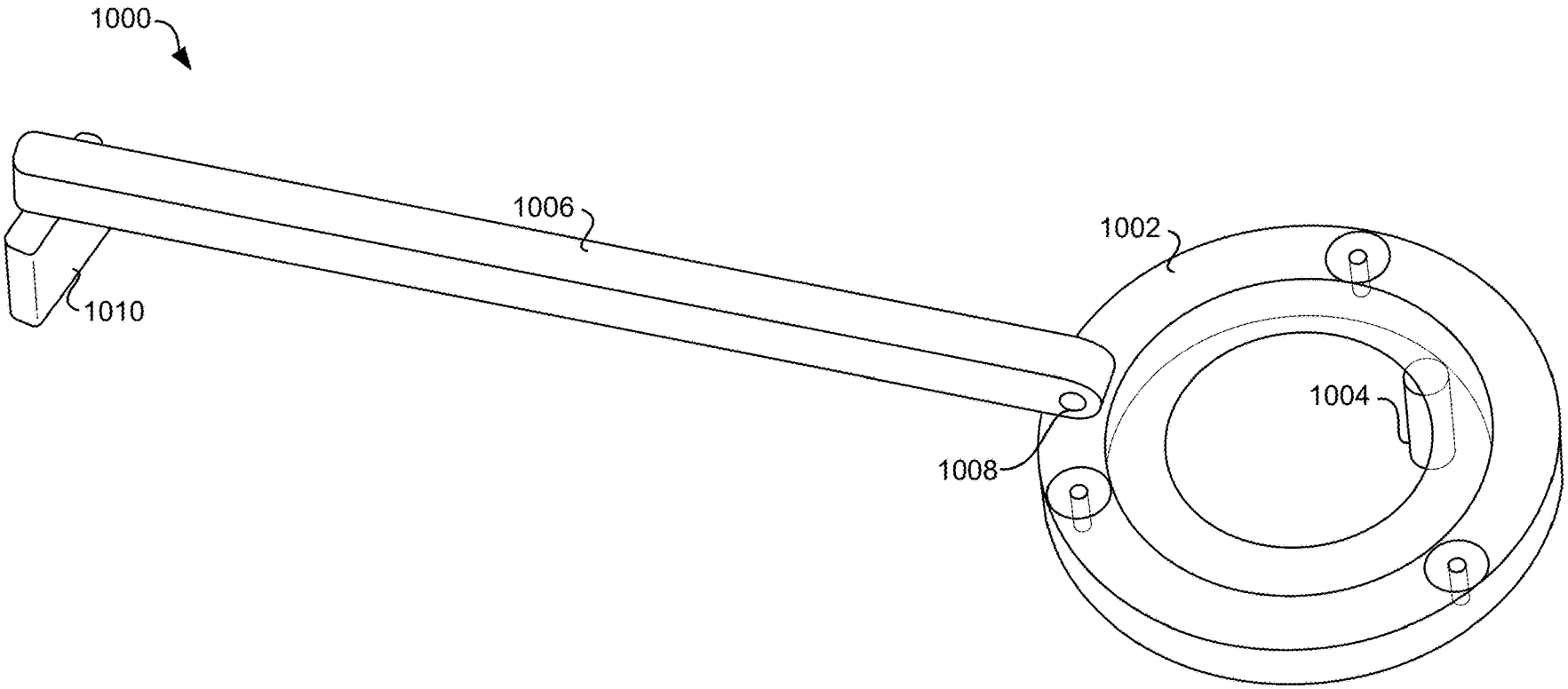
FIG. 10 illustrates a folding handle for a crank-powered airgun in a first state, according to an example.
Figure 11:
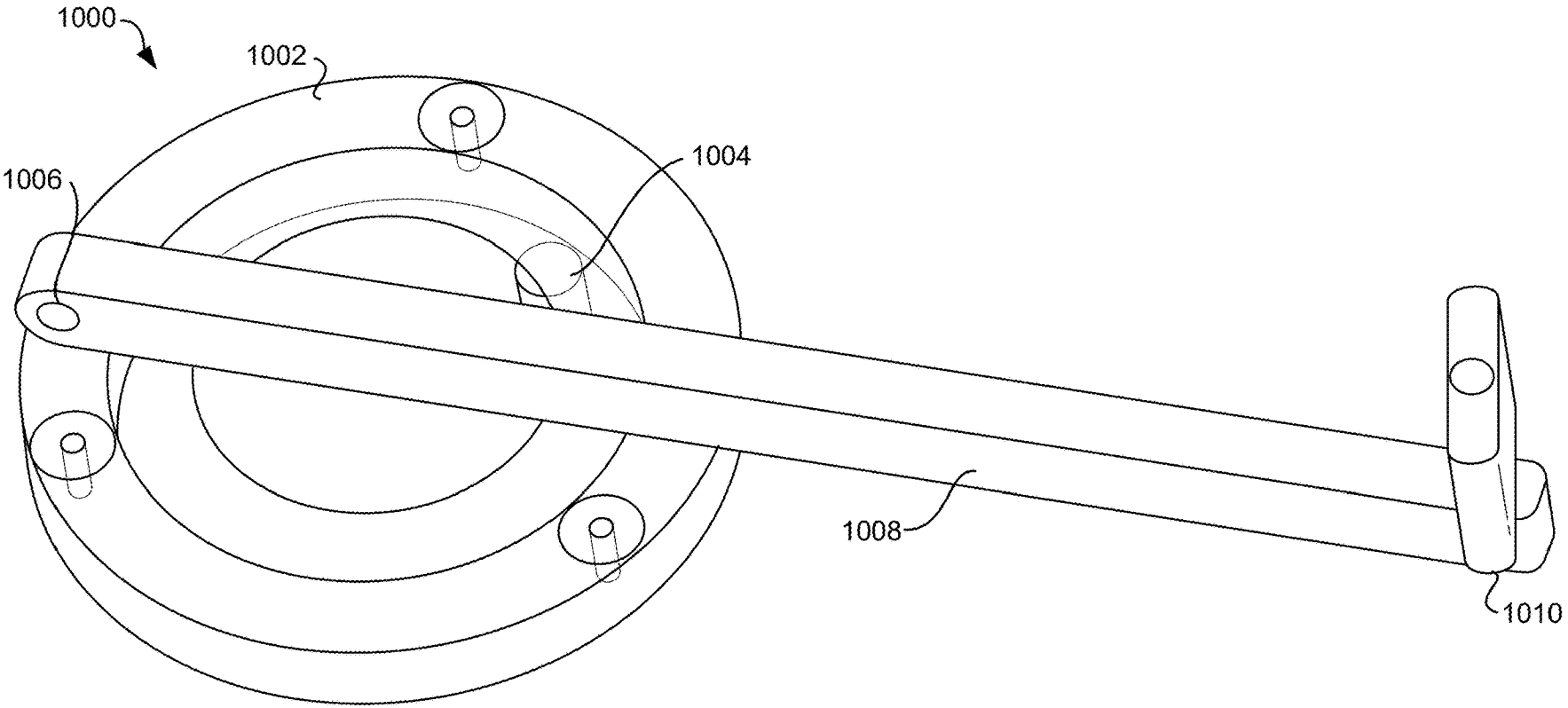
FIG. 11 illustrates the folding handle of FIG. 10 in a second state, according to an example.

FIGS. 10 and 11 illustrate a folding handle 1000 for a crank-powered airgun. FIG. 10 illustrates the folding handle 1000 in a first state and FIG. 11 illustrates the folding handle 1000 in a second state, according to an example. The folding handle 1000 may be an example of the crank used to wind the drum as described with respect to various embodiments herein.

The folding handle 1000 is a pivotable crank handle that may be in folded and unfolded positions, and that may be configured to engage and disengage the crank handle from a gear in an airgun. The folding handle 1000 includes a ring 1002, pin 1004, crank arm 1006, pivot 1008, and handle 1010. The crank arm 1006 may be folded at the pivot 1008 between the configuration shown in FIG. 10 and the configuration shown in FIG. 11. In FIG. 10, the crank arm 1006 and handle 1010 may be in a stowable configuration and FIG. 11 may show the folding handle in an engaged configuration. In the stowable configuration the crank arm 1006 and handle 1010 may be out of the way of a user during user of the airgun. The crank arm 1006 may pivot from the ring 1002 and the handle 1010 may secure or stow in a secure location on the airgun such that the handle does not catch on clothing of the user or other nearby objects. The crank arm 1006 pivots about the pivot 1008 and interacts with a pin 1004 to provide leverage for rotating the crank assembly (and thereby rotating the series of gears as described herein). The ring 1002 and/or pin 1004 may be operably connected to the crank gear and when the crank arm 1006 is unfolded, rotation of the crank arm 1006 will drive the crank gear as described herein. The crank arm 1006 may be rotated to a specified angle or position and stowed away to remain out of the way when not actively used to pressurize the gas in the pressure chamber of the airgun.

Figure 12:
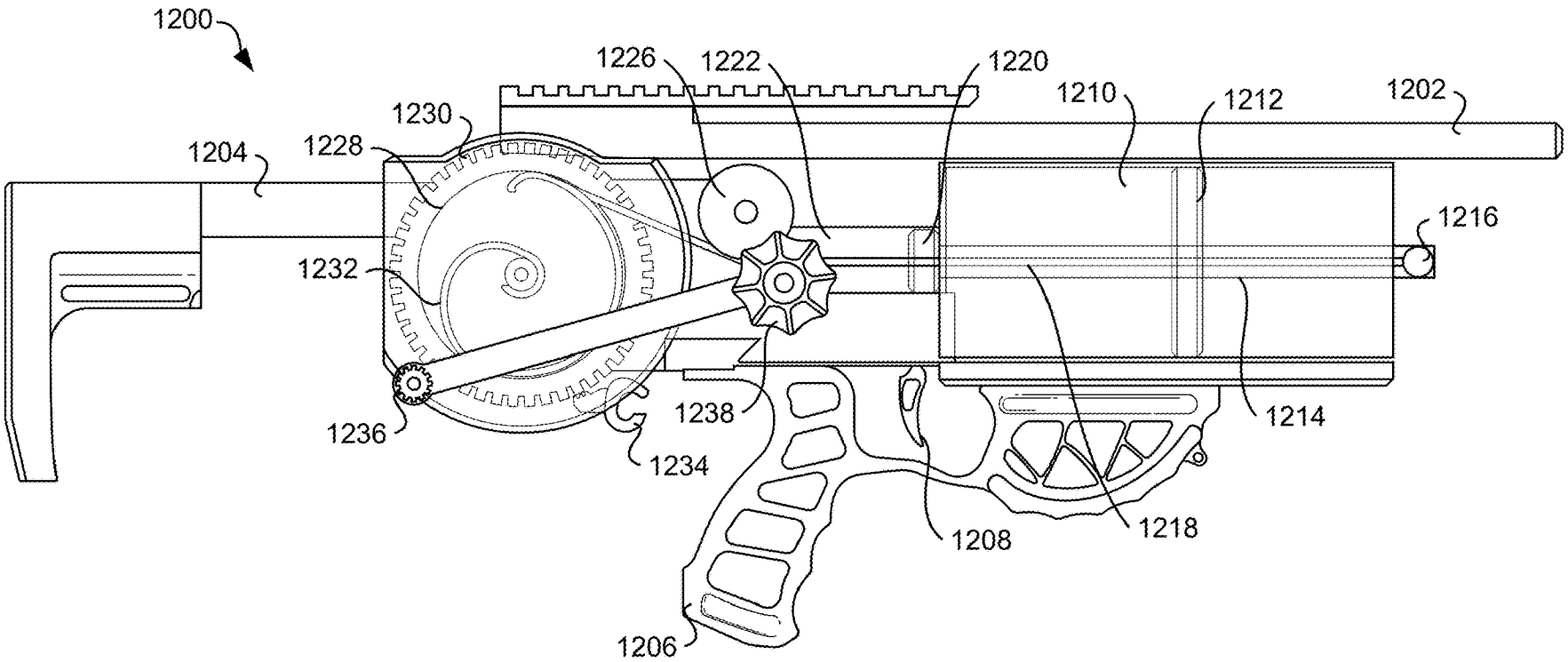
FIG. 12 illustrates an airgun having a dual stage air cylinder charged by a cable and crank system, according to an example.
Figure 13:
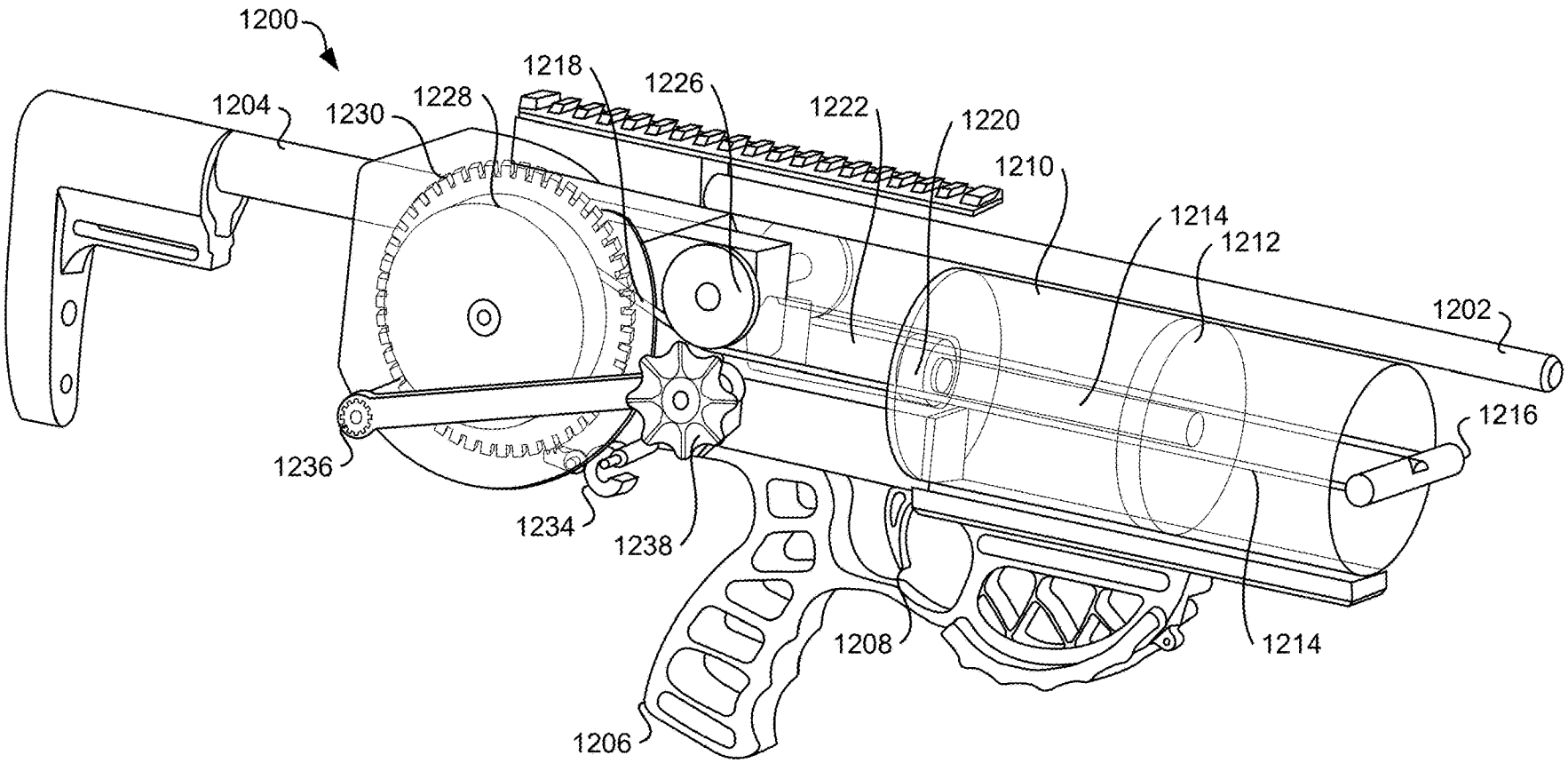
FIG. 13 illustrates a perspective view of the airgun of FIG. 12, according to an example.

FIG. 12 and FIG. 13 illustrate an airgun 1200 having a dual stage air cylinder charged by a cable and crank system, according to an example. The airgun 1200 includes a barrel 1202, stock 1204, grip 1206, and trigger 1208. The airgun 1200 includes a two-stage air system includes a first cylinder 1210 with a first piston 1212 and a second cylinder 1222 with a second piston 1220. The first piston 1212 and the second piston 1220 may be coupled together by a shaft 1214 to drive the pistons. The pistons and/or shaft may additionally include one or more guide elements to ensure the pistons move squarely within the cylinders. The shaft 1214 terminates at an end 1216 where a cable 1218 couples to the shaft 1214 to drive the pistons and compress air within the cylinders.

The cable 1218 may wrap around a drum 1228 or around some other such device as driven by a crank 1238 after passing a guide 1226. In some examples, the cable 1218, drum 1228, and crank 1238 may be replaced by other motive systems that apply force to the pistons to compress air within the cylinders. The crank 1238 makes the benefits of resilient power plants available in a form that may be any of more easily primed, more easily cocked, more easily loaded, fired with greater force and fired more accurately. The drum 1228 may include a spiral surface 1232 as described herein in addition to a ratchet system 1234.

As shown in FIGS. 12 and 13, as the crank 1238 is rotated, the crank gear 1236 rotates and causes rotation of the drum 1228 and the cable 1218 is wrapped around the drum 1228, thereby applying a force on the shaft 1214 to drive the pistons towards the rear of the airgun 1200, and compress air within the cylinders. The compression shrinks the volume of gas and increases the pressure of the gas within the air system. As the air volume shrinks, the gas exerts increasing amounts of force against the pistons, increasing the cranking force necessary to rotate the crank 1238. The two-stage system enables air to be compressed to a first pressure level within the first cylinder 1210 by the first piston 1212 and then compressed further within the second cylinder 1222 by the second piston 1220. A valve (e.g., a pressure bleeder valve) may allow air to travel from the first cylinder 1210 to the second cylinder 1222 where it may be compressed further through the single action of the crank 1238.

Figure 14:
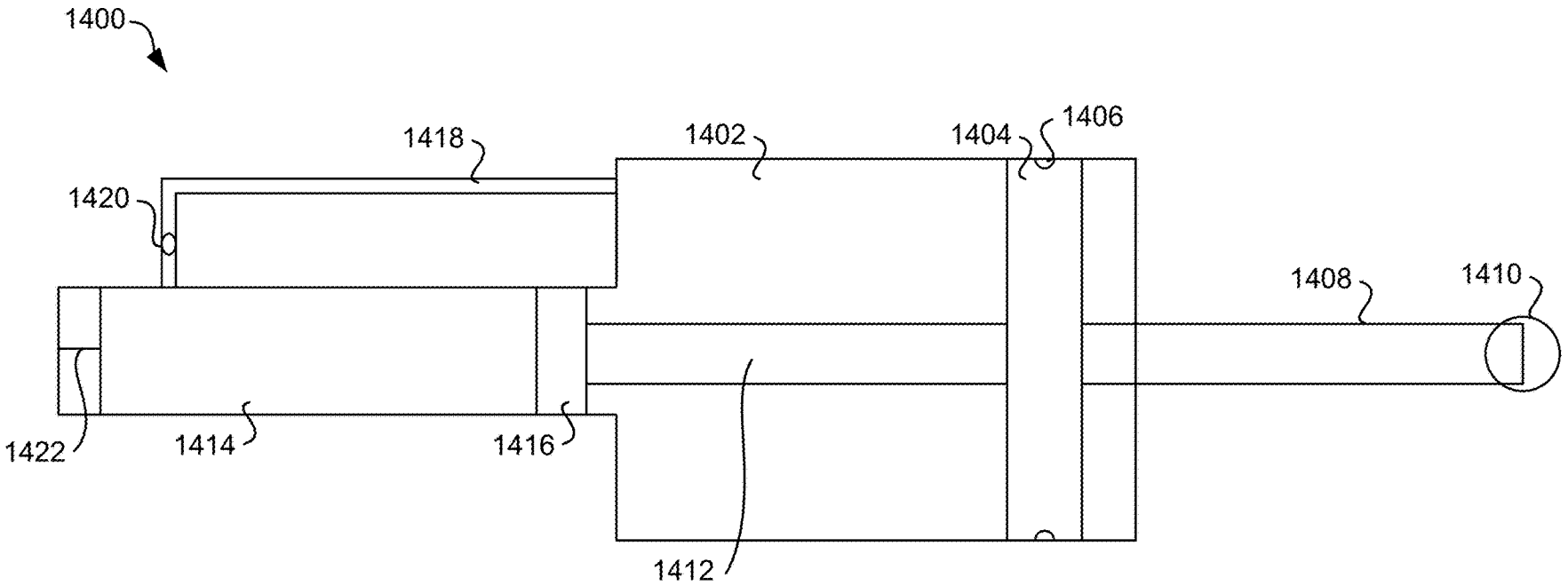
FIG. 14 illustrates a schematic view of a dual stage air cylinder for an airgun, according to an example.

In some examples, such as depicted in FIG. 14, the first piston 1212 and the second piston 1220 are connected in tandem to a single shaft 1214 and are set a fixed distance apart. In some examples, the first piston 1212 may be driven by a first shaft having a force applied thereto (such as by the cable 1218) and subsequently, after a predetermined amount of travel or load is applied, a second shaft that is coupled to the second piston 1220 may be driven through the use of the single motive force. Accordingly, air may be pre-compressed within the first cylinder 1210 to a predetermined pressure level before any compression is applied to the second cylinder 1222.

Compression of the air takes place in both cylinders, simultaneously, to enable higher pressures to be reached. Additionally, the large cross-sectional area of the first cylinder 1210 and the smaller cross-sectional area of the second cylinder 1222 may enable higher pressure values to be reached that would be possible, given the same effort through the crank 1238 or other motive system, with a single piston system.

To enable a user to rotate crank 1238 within a predetermined range of force during priming, a gear ratio between the crank and the gear teeth 1230 of the drum 1228 is defined that reduces the peak forces required to move the pistons against the increasing resistance of the gas in the chambers. One or both of the pistons are moved to a location where compression piston engages and is captured by a sear mechanism. The airgun 1200 is designed so that shot volume and therefore the amount of gas in shot volume reaches a desired level when one or both of the pistons are captured by the sear.

FIG. 14 illustrates a schematic view of a dual stage air system 1400 for an airgun, according to an example. The dual stage air system 1400 may be implemented in an airgun to pre-charge air, according to the instant disclosure. The dual stage air system may include a linkage 1408 and bearing 1410 for connecting to and being driven by a cable as described herein. The dual stage air system 1400 includes a first cylinder 1402 with a first piston 1404 having a seal 1406 with the wall of the first cylinder 1402. The dual stage air system 1400 also includes a second cylinder 1414 with a second piston 1416. The first cylinder 1402 is fluidly coupled with the second cylinder 1414 through a conduit 1418 that includes a valve 1420 such as a check valve that allows air to flow into the second cylinder 1414 but prevents backflow through the conduit 1418. The first piston 1404 and second piston 1416 are driven by a shaft 1412 that receives a force from a motive system of the airgun (crank-powered, break-barrel, spring actuated, or otherwise). A valve 1422 releases pressurized gas from the second cylinder 1414 to a receiver and barrel of an airgun for launching a projectile.

Figure 15:
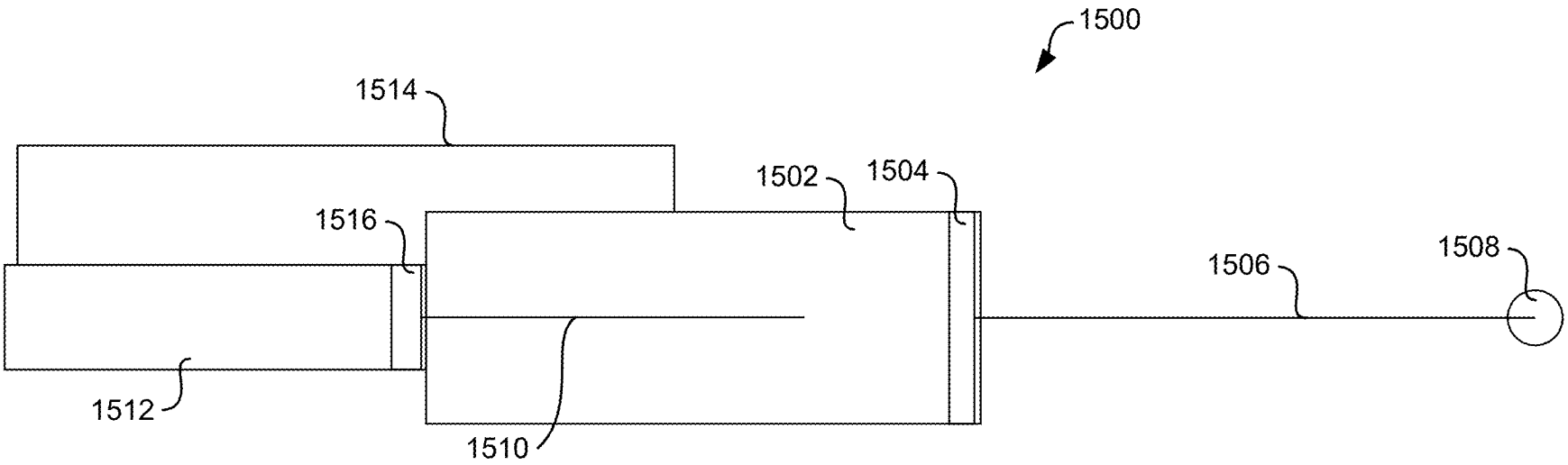
FIG. 15 illustrates a schematic view of a dual stage air cylinder with a delayed compression stroke, according to an example.

FIG. 15 illustrates a schematic view of a dual stage air system 1500 with a delayed compression stroke, according to an example. The dual stage air system 1500 may be implemented in an airgun to pre-charge air, according to the instant description. The dual stage air system 1500 may be similar to the system shown and described with respect to FIG. 14 above. The dual stage air system 1500 includes a first cylinder 1502 with a first piston 1504 having a first diameter and a second cylinder 1512 with a second piston 1516 having a second diameter. The second diameter is smaller than the first diameter. The first piston 1504 is coupled to a shaft 1506 that drives the piston based on a force applied at end 1508, such as from a cord or cable of a crank-operated airgun. The second piston 1516 is coupled to a second shaft 1510. The first piston 1504 advances along the first cylinder 1502 and contacts the second shaft 1510 to cause motion of the second piston 1516 after the first piston 1504 has moved a predetermined distance. The first cylinder 1502 and the second cylinder 1512 are coupled through a conduit 1514 that includes a check valve to allow pressurized gas to flow from the first cylinder 1502 to the second cylinder 1512 but to prevent backflow of pressurized gas. In this manner, the second cylinder 1512 may be used to further increase the pressure of gas through the single action of a crank or other energy input system of the airgun.

Figure 16:
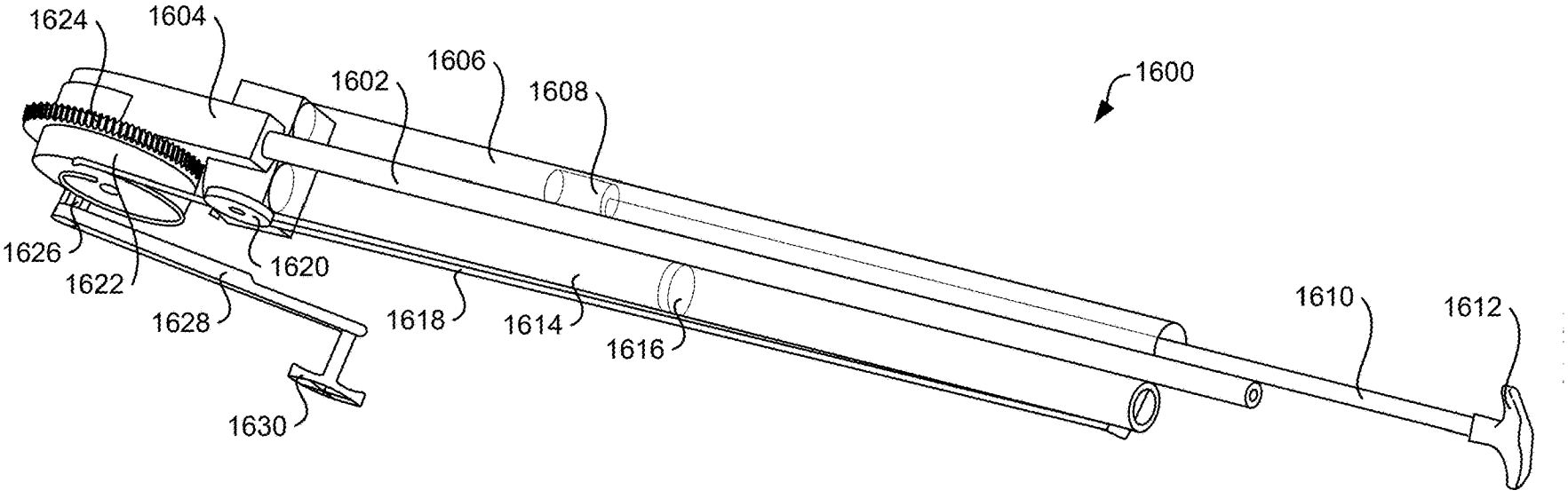
FIG. 16 illustrates a perspective view of an airgun having a pre-charge air cylinder and a cylinder compressible by a crank and cable system, according to an example.

FIG. 16 illustrates a perspective view of an airgun 1600 having a pre-charge air cylinder and a cylinder compressible by a crank and cable system, according to an example. The airgun 1600 includes a barrel 1602 for firing projectiles using compressed gas. The airgun 1600 also includes a receiver 1604 for loading projectiles and releasing compressed gas to launch the projectile along the barrel 1602. The airgun 1600 includes multiple chambers that may be compressed independently. In the example shown in FIG. 16, a first chamber 1606 includes a first piston 1608 driven by a shaft 1610 and a handle 1612 that may be manually pumped or compressed to compress gas in the first chamber 1606. A second chamber 1614 with a second piston 1616 is compressed through a cable 1618, guide 1620, and drum 16212 similar to the configurations described herein. The drum 1622 may be driven by gear teeth 1624 and a crank gear 1626 actuated by a crank 1628 and a handle 1630. In an example, gas may be compressed to a first level in the first chamber 1606 and the pressurized gas may be transferred to the second chamber 1614 and/or in fluid communication with the second chamber 1614. The crank 1628 may then be used to further compress the gas to a level higher than would be feasible using the hand pump of the first chamber 1606 due to the mechanical advantage of the crank gear 1626 and gear teeth 1624.

In some examples, the crank may be used to independently actuate the two cylinders with a single crank that is actuatable to select whether to engage a drum associated with a piston of the first chamber 1606 and/or a drum associated with a piston of the second chamber 1614. The chambers may be in fluid communication such that compressing either of the pistons increases the pressure in both chambers simultaneously. In some examples the chambers may be separate such that the pressure level in each may be independently usable for firing projectiles and thereby be used to fire a greater number of projectiles than would be possible with a single chamber.

In some examples, such as illustrated, the first cylinder may be pre-charged with a manual crank or other such pressure system to pre-charge the system. The first cylinder may be coupled to the second cylinder with a check valve such that the second cylinder may have a first level of pressure before cranking begins, and the pressurized gas may not backflow into the first cylinder. The pre-charged second cylinder may be pressurized through the use of the crank and piston as described herein to reach additional high pressure loads for firing the airgun 1600.

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims.

What is claimed is:

1. An airgun comprising:

a pressure chamber comprising a cylinder extending along a length of an axis of the airgun parallel with an axis of a barrel of the airgun;

a piston disposed within the pressure chamber and translatable along a length of the cylinder to pressurize gas in the pressure chamber in response to an increase in force applied to the piston;

a rotating drum connected to a frame of the airgun;

a cable operably connected to the piston and the rotating drum; and a crank handle operably connected to the rotating drum and configured to cause rotation of the rotating drum to increase tension on the cable and force on the piston to compress the gas in the pressure chamber.

2. The airgun of claim 1, further comprising:

a rod connected to the piston and extending along a portion of the length of the cylinder, wherein the cable is connected at a first end to the rotating drum and engages with the rod to apply force to the piston.

3. The airgun of claim 1, wherein the rotating drum comprises:

a first surface at a first diameter configured to receive the cable as the rotating drum rotates;

a second surface at a second diameter smaller than the first diameter; and a spiral surface extending between the first surface and the second surface, wherein the cable is configured to wrap against the first surface, the spiral surface, and the second surface as the rotating drum is rotated.

4. The airgun of claim 1, wherein:

the crank handle is connected to a crank gear having a first diameter; and the rotating drum is connected to a gear having a second diameter, the second diameter greater than the first diameter, the rotating drum configured to rate in response to rotation of the crank handle through the crank gear.

5. The airgun of claim 4, wherein the crank handle comprises a first rotational connection connecting the crank handle and the crank gear and a second rotation connection configured to enable the crank handle to pivot for storing against a frame of the airgun.

6. The airgun of claim 1, further comprising a bearing surface connected to a rod extending from the piston, wherein the pressure chamber comprises a first portion configured to engage with the piston and a second portion, the second portion enclosing the rod and defining:

a cylindrical passage concentric with the cylinder; and a slot in a wall of the second portion for coupling the bearing surface to the rod.

7. The airgun of claim 1, further comprising a ratchet assembly configured to engage with an exterior perimeter of the rotating drum to prevent rotation of the rotating drum in a first direction when engaged.

8. A pressure system for an airgun comprising:

a cylinder comprising a pressure chamber and an extended cylinder;

a piston disposed within the cylinder and configured to compress a gas within the pressure chamber;

a guide element extending through a wall of the extended cylinder and configured to maintain stability of the piston within the cylinder;

a linkage connecting the guide element to the piston;

a rotating drum connected to a frame of the airgun;

a cable operably connected to the piston and the rotating drum; and a crank handle operably connected to the rotating drum and configured to cause rotation of the rotating drum to increase tension on the cable and force on the piston to compress the gas in the pressure chamber.

9. The pressure system of claim 8, wherein the rotating drum comprises:

a first surface at a first diameter configured to receive the cable as the rotating drum rotates;

a second surface at a second diameter smaller than the first diameter; and a spiral surface extending between the first surface and the second surface, wherein the cable is configured to wrap against the first surface, the spiral surface, and the second surface as the rotating drum is rotated.

10. The pressure system of claim 8, wherein:

the crank handle is connected to a crank gear having a first diameter; and the rotating drum is connected to a gear having a second diameter, the second diameter greater than the first diameter, the rotating drum configured to rate in response to rotation of the crank handle through the crank gear.

11. The pressure system of claim 8, wherein the pressure chamber comprises a first pressure chamber and a second pressure chamber and the piston comprises a first piston and a second piston, wherein rotation of the crank handle is configured to apply a force to the first piston and the second piston.

12. The pressure system of claim 11, wherein the first pressure chamber and the second pressure chamber are arranged in parallel along a length of the airgun.

13. The pressure system of claim 11, wherein the first pressure chamber is disposed coaxially with the second pressure chamber adjacent an end of the second pressure chamber, and wherein the first piston and the second piston are operably connected by a rod extending from the first piston into the second pressure chamber such that movement of the first piston causes movement of the second piston.

14. The pressure system of claim 13, wherein the first pressure chamber has a first diameter and the second pressure chamber has a second diameter, the second diameter less than the first diameter.

15. An airgun comprising:

a frame including a user interface surface and a trigger configured to cause release of pressurized gas for firing a projectile; and a pressure system including:

a cylinder comprising a pressure chamber and an extended cylinder;

a piston disposed within the cylinder and configured to compress a gas within the pressure chamber;

a guide element extending through a wall of the extended cylinder and configured to maintain stability of the piston within the cylinder;

a linkage connecting the guide element to the piston;

a rotating drum connected to a frame of the airgun;

a cable operably connected to the piston and the rotating drum; and a crank handle operably connected to the rotating drum and configured to cause rotation of the rotating drum to increase tension on the cable and force on the piston to compress the gas in the pressure chamber.

16. The airgun of claim 15, wherein the rotating drum comprises:

a first surface at a first diameter configured to receive the cable as the rotating drum rotates;

a second surface at a second diameter smaller than the first diameter; and a spiral surface extending between the first surface and the second surface, wherein the cable is configured to wrap against the first surface, the spiral surface, and the second surface as the rotating drum is rotated.

17. The airgun of claim 15, wherein the pressure chamber comprises a first pressure chamber and a second pressure chamber and the piston comprises a first piston and a second piston, wherein rotation of the crank handle is configured to apply a force to the first piston and the second piston.

18. The airgun of claim 17, wherein the first pressure chamber and the second pressure chamber are arranged in parallel along a length of the airgun.

19. The airgun of claim 17, wherein the first pressure chamber is disposed coaxially with the second pressure chamber adjacent an end of the second pressure chamber, and wherein the first piston and the second piston are operably connected by a rod extending from the first piston into the second pressure chamber such that movement of the first piston causes movement of the second piston.

20. The airgun of claim 19, wherein the first pressure chamber has a first diameter and the second pressure chamber has a second diameter, the second diameter less than the first diameter.

* * * * *